US008871415B2

(12) United States Patent
Nagasawa et al.

(10) Patent No.: US 8,871,415 B2
(45) Date of Patent: Oct. 28, 2014

(54) TONER FOR ELECTROSTATIC IMAGE DEVELOPMENT

(71) Applicant: Konica Minolta, Inc., Tokyo (JP)

(72) Inventors: Hiroshi Nagasawa, Tokyo (JP); Kouji Sugama, Tokyo (JP); Hiroyuki Konno, Tokyo (JP); Takaki Kawamura, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/864,547

(22) Filed: Apr. 17, 2013

(65) Prior Publication Data

US 2013/0280649 A1 Oct. 24, 2013

(30) Foreign Application Priority Data

Apr. 18, 2012 (JP) ..... 2012-094583

(51) Int. Cl.
*G03G 9/087* (2006.01)
*G03G 9/097* (2006.01)

(52) U.S. Cl.
CPC ..... *G03G 9/09733* (2013.01); *G03G 9/08728* (2013.01); *G03G 9/08711* (2013.01); *G03G 9/08755* (2013.01); *G03G 9/08795* (2013.01); *G03G 9/08797* (2013.01)
USPC ..... 430/108.4; 430/109.3; 430/109.4

(58) Field of Classification Search
CPC ..... G03G 9/08711; G03G 9/08728
USPC ..... 430/109.3, 108.4, 109.4
See application file for complete search history.

(56) References Cited

U.S. PATENT DOCUMENTS

| | | | | |
|---|---|---|---|---|
| 7,150,952 | B2 * | 12/2006 | Matsushima et al. | 430/108.1 |
| 2007/0254229 | A1 * | 11/2007 | Patel et al. | 430/108.4 |
| 2008/0261133 | A1 * | 10/2008 | Maehata et al. | 430/109.3 |
| 2010/0330489 | A1 * | 12/2010 | Inoue et al. | 430/108.4 |

FOREIGN PATENT DOCUMENTS

| | | | | | |
|---|---|---|---|---|---|
| JP | 4-24648 | A | | 1/1992 | |
| JP | 05002286 | A | * | 1/1993 | G03G 9/087 |
| JP | 05011493 | A | * | 1/1993 | G03G 9/087 |
| JP | 2001-222138 | A | | 8/2001 | |
| JP | 2003057877 | A | * | 2/2003 | G03G 9/087 |
| JP | 2004-286842 | A | | 10/2004 | |
| JP | 2011127102 | A | * | 6/2011 | |
| JP | 2011-149999 | A | | 8/2011 | |

OTHER PUBLICATIONS

English language machine translation of JP 05-2286 (Jan. 1993).*
English language machine translation of JP 5-11493 (Jan. 1993).*
English language machine translation of JP 2003-57877 (Feb. 2003).*
English language machine translation of JP 2011-127102 (Jun. 2011).*

* cited by examiner

*Primary Examiner* — Christopher Rodee
(74) *Attorney, Agent, or Firm* — Lucas & Mercanti, LLP

(57) ABSTRACT

There is provided a toner for electrostatic-image development that can obtain heat-resistant storability, fixed image strength and long-term stability of charging while having excellent low-temperature fixing property. The toner is formed, with toner particles containing a binder resin and a crystalline ester compound, and the binder resin contains a styrene-acrylic resin including a structural unit derived from an acrylic ester monomer.

15 Claims, No Drawings

TONER FOR ELECTROSTATIC IMAGE DEVELOPMENT

CROSS REFERENCE TO RELATED APPLICATION

This Application claims the priority of Japanese Patent Application No. 2012-094583 filed on Apr. 18, 2012, which is incorporated herein by reference in its entirety.

BACKGROUND OF THE INVENTION

1. Field of the Invention

The present invention relates to a toner for electrostatic-image development, which is used for image formation of an electrophotographic method.

2. Description of the Related Art

In recent years, in order to further save energy in the image forming device of an electrophotographic method, there has been required a toner for electrostatic-image development (which hereinafter may be simply referred to as a "toner") with which heat fixing can be performed at a lower temperature. In such a toner, in order to achieve more excellent low-temperature fixing property and stably form a high quality image over a long period of time, there has been required a toner that satisfies long-term stability of charging.

As a toner having low-temperature fixing property, for example, there is proposed a toner to which low-temperature plasticity and flexibility are imparted through the use of, as a binder resin, a copolymer of a macromonomer obtained by binding, to a vinyl monomer, an oligomer of a resin having a low glass-transition temperature or a low melting point (for example, see Patent Literature 1).

In addition, for example, there is widely known a toner that contains a crystalline material as a fixing aid, specifically, a crystalline ester compound such as a crystalline polyester resin or a fatty acid ester compound (for example, see Patent Literature 2).

However, with the toner as disclosed in Patent Literature 1, it has not been possible to satisfactorily obtain both low-temperature fixing property and heat-resistant storability.

Moreover, in the toner containing the fixing aid as disclosed in Patent Literature 2, there exists a problem in which it is not possible to obtain a sufficient strength of a fixed image formed due to a low compatibility between a crystalline ester compound and a binder resin at the time of heat fixing or a problem of a low long-term stability of charging such as the change in the quality of the image formed when an image is formed over a long period of time.

In order to solve such problems, it is proposed that by the control of the compatibility between a binder resin and a crystalline ester compound, the crystalline ester compound is caused to exist in a crystallized state in toner particles, and the crystalline ester compound and the binder resin are made compatible with each other at the time of heat fixing, with the result that both low-temperature fixing property and long-term stability of charging are obtained (see Patent Literatures 3 and 4).

However, in fact, with the toner as described above, it is not possible to sufficiently satisfy the requests for low-temperature fixing property and long-term stability of charging, which are being increasingly made.

CITATION LIST

Patent Literature

[Patent Literature 1] Japanese Patent Application Laid-Open No. 04-024648

[Patent Literature 2] Japanese Patent Application Laid-Open No. 2001-222138

[Patent Literature 3] Japanese Patent Application Laid-Open No. 2004-286842

[Patent Literature 4] Japanese Patent Application Laid-Open No. 2011-149999

SUMMARY OF THE INVENTION

The present invention is made in view of the foregoing conditions; an object of the present invention is to provide a toner for electrostatic-image development that can obtain heat-resistant storability, fixed image strength and long-term stability of charging while having excellent low-temperature fixing property.

A toner for electrostatic-image development according to the present invention is formed with toner particles containing a binder resin and a crystalline ester compound, wherein the binder resin contains a styrene-acrylic resin including a structural unit derived from an acrylic ester monomer represented by any of general formulae (1) to (3) below:

General formula (1)

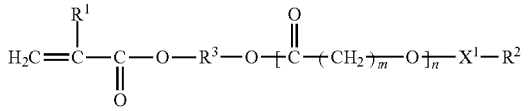

[in the general formula (1), $R^1$ represents a hydrogen atom or a methyl group, $X^1$ represents a single bond or —C(═O)—, $R^2$ represents a hydrogen atom, an alkyl group having 1 to 16 carbon atoms or an aryl group having 6 to 15 carbon atoms and $R^3$ represents an alkylene group having 1 to 8 carbon atoms which may contain —O— or —C(═O)—. m represents an integer of 2 to 12 and n represents an integer of 2 to 20.];

General formula (2)

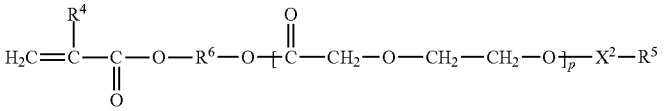

[in the general formula (2), $R^4$ represents a hydrogen atom or a methyl group, $X^2$ represents a single bond or —C(=O)—, $R^5$ represents a hydrogen atom, an alkyl group having 1 to 16 carbon atoms or an aryl group having 6 to 15 carbon atoms and $R^6$ represents an alkylene group having 1 to 8 carbon atoms which may contain —O— or —C(=O)—. p represents an integer of 2 to 20.]; and General formula (3)

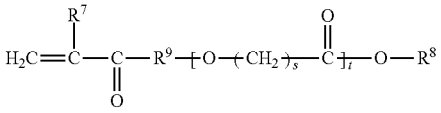

[in the general formula (3), $R^7$ represents a hydrogen atom or a methyl group, $R^8$ represents a hydrogen atom, an alkyl group having 1 to 16 carbon atoms or an aryl group having 6 to 15 carbon atoms and $R^9$ represents a single bond or an alkylene group having 1 to 8 carbon atoms which may contain —O— or —C(=O)—. s represents an integer of 2 to 12 and t represents an integer of 2 to 20.]

In the toner for electrostatic-image development according to the present invention, a ratio of the acrylic ester monomer represented by any of the general formulae (1) to (3) to all monomers used for formation of the styrene-acrylic resin is preferably 2 to 12% by mass.

In the toner for electrostatic-image development according to the present invention, in the general formulae (1) to (3), preferably, $R^1$, $R^4$ and $R^7$ are each methyl groups.

Moreover, in the general formulae (1) and (2), preferably, each of $X^1$ and $X^2$ is —C(=O)—.

Furthermore, in the general formulae (1) to (3), preferably, $R^2$, $R^5$ and $R^8$ each are each methyl groups.

In addition, in the general formulae (1) and (2), preferably, $R^3$ and $R^6$ are each ethylene groups.

Moreover, in the general formula (3), $R^9$ has preferably a single bond.

Furthermore, in the general formulae (1) and (3), preferably, m and s are each integers of 4 to 6.

In addition, in the general formulae (1) to (3), preferably, n, p and t are each integers of 5 to 10.

In the toner for electrostatic-image development according to the present invention, a content of the crystalline ester compound in the toner particles is preferably 1 to 30% by mass.

In the toner for electrostatic-image development according to the present invention, the crystalline ester compound is preferably a compound having two or more ester bonds, and is more preferably a crystalline polyester resin having four or more ester bonds.

Preferably, in the toner for electrostatic-image development according to the present invention, when a solubility parameter value of the crystalline ester compound is SP(E) and a solubility parameter value of the acrylic ester monomer is SP(M), SP(E)≤SP(M) is satisfied.

In the toner for electrostatic-image development according to the present invention, the toner particles preferably contain a wax having a composition different from a composition of the crystalline ester compound.

Preferably, in the toner for electrostatic-image development according to the present invention, when a solubility parameter value of the crystalline ester compound is SP(E) and a solubility parameter value of the wax is SP(W), SP(W) <SP(E) is satisfied.

Effects of the Invention

According to the toner of the present invention, the styrene-acrylic resin constituting the binder resin of the toner includes a structural unit derived from the acrylic ester monomer represented by any of the general formulae (1) to (3) described above, and thus it is possible to obtain a high affinity between the styrene-acrylic resin and the crystalline ester compound, with the result that it is possible to obtain heat-resistant storability, fixed image strength and long-term stability of charging while having excellent low-temperature fixing property.

DESCRIPTION OF THE EMBODIMENTS

Hereinafter, the present invention will be specifically described.

(Toner)

The toner of the present invention is formed with toner particles containing a binder resin and a crystalline ester compound, and the binder resin contains a styrene-acrylic resin (hereinafter also referred to as a "specific styrene-acrylic resin") including a structural, unit (hereinafter also referred to as a "polyester chain-containing structural unit") derived from an acrylic acid ester monomer (hereinafter also referred to as a "polyester chain-containing monomer") represented by any of the general formulae (1) to (3) described above.

The specific styrene-acrylic resin is contained in the binder resin, and thus it is possible to obtain heat-resistant storability, fixed image strength and long-term stability of charging while having excellent low-temperature fixing property.

This is probably because the crystalline ester compound exists in a crystallized state in the binder resin of the toner particles before heat fixing, and the crystalline ester compound becomes compatible with the specific styrene-acrylic resin in the binder resin at the time of heat fixing.

Specifically, a polyester chain introduced into the specific styrene-acrylic resin has a high affinity for an ester binding portion of the crystalline ester compound.

It is estimated that, in the toner particles before heat fixing, the formation of a structure in which the polyester chain of the binder resin enters the crystal portion of the crystalline ester compound causes crystallization. Accordingly, within the toner particles, the domains of the crystalline ester compound are uniformly dispersed, and thus the crystalline ester compound can be reliably caused to exist in a crystallized state within the toner particles. Therefore, the crystalline ester compound is prevented from being liberated and exposed to the surface of the toner particles, with the result that heat-resistant storability is obtained and the decrease in charging is prevented over a long period of time.

In contrast, it is estimated that, since, at the time of heat fixing, the structure in which the polyester chain enters the crystal portion of the crystalline ester compound is uniformly formed in the toner, when the crystalline ester compound melts at about its melting point, this portion functions as a trigger to rapidly and uniformly facilitate the plasticity of the binder resin, and thus it is possible to obtain excellent low-temperature fixing property.

Furthermore, it is possible to obtain a sufficient strength of the fixed image formed by a high compatibility between the crystalline ester compound and the specific styrene-acrylic resin.

[Binder Resin]

The binder resin for the toner of the present invention may contain another resin as long as it contains the specific styrene-acrylic resin.

[Specific Styrene-Acrylic Resin]

The specific styrene-acrylic resin constituting the binder resin contains the polyester chain-containing structural unit derived from the polyester chain-containing monomer.

The specific styrene-acrylic resin may be, for example, a styrene-acrylic resin including a copolymer of the polyester chain-containing monomer represented by any of the general formulae (1) to (3) described above and another monomer or may be a styrene-acrylic resin including a mixture resin of the copolymer formed with the polyester chain-containing monomer and another monomer and a (co)polymer formed with a monomer excluding the polyester chain-containing monomer.

In general formulae (1) to (3) described above representing the polyester chain-containing monomer, $R^1$, $R^4$ and $R^7$ each represent a hydrogen atom or a methyl group, and, in particular, they preferably represent a methyl group.

In addition, $X^1$ and $X^2$ each represent a single bond or —C(═O)—, and, in particular, they preferably represent —C(═O)—.

Furthermore, $R^2$, $R^5$ and $R^8$ each represent a hydrogen atom or an alkyl group having 1 to 1.6 carbon atoms or an aryl group having 6 to 15 carbon atoms, and, in particular, they preferably represent a methyl group.

Moreover, $R^3$ and $R^6$ each represent an alkylene group having 1 to 8 carbon atoms which may include —O— or —C(═O)—, among them, they preferably represent an alkylene group having 2 to 8 carbon atoms and, in particular, they preferably represent an ethylene group. $R^9$ represents an alkylene group having 1 to 8 carbon atoms which may include a single bond or —O— or —C(═O)—, among them, it preferably represents an alkylene group having 2 to 8 carbon atoms and, in particular, it preferably represents a single bond.

Moreover, in general formulae (1) and (3) described above representing the polyester chain-containing monomer, m and s each represent integers of 2 to 12, and they preferably represent integers of 4 to 6.

Furthermore, in general formulae (1) to (3) described above representing the polyester chain-containing monomer, n, p and t each represent integers of 2 to 20, and they preferably represent integers of 5 to 10.

In particular, the weight-average molecular weight (Mw) of the polyester chain determined by the number of n, p or t is preferably 200 to 2,500, is more preferably 300 to 1,500 and is further preferably 400 to 1,200.

The weight-average molecular weight (Mw) of the polyester chain falls within the above-described range, and thus it is possible to reliably obtain an interaction between the polyester chain and the crystalline ester compound.

Specifically, as the polyester chain-containing monomer represented by the general formula (1) described above, a polyester chain-containing monomer where $R^1$ is a methyl group, $X^1$ is —C(═O)—, $R^2$ is a methyl group, $R^3$ is an ethylene group, m is 5 and n is 5 to 10 is preferably used.

In addition, specifically, as the polyester chain-containing monomer represented by the general formula (2) described above, a polyester chain-containing monomer in which $R^4$ is a methyl group, $X^2$ is —C═)—, $R^5$ is a methyl group, $R^6$ is an ethylene group and p is 5 to 10 is preferably used.

Furthermore, specifically, as the polyester chain-containing monomer represented by general formula (3), a polyester chain-containing monomer in which $R^7$ is a methyl group, $R^8$ is a methyl group, $R^9$ is a single bond, s is 5 and t is 5 to 10 is preferably used.

As the polyester chain-containing monomer for forming the specific styrene-acrylic resin of the present invention, a polyester chain-containing monomer having its solubility parameter value SP(M) equal to or more than the solubility parameter value SP(E) of the crystalline ester compound is preferably used, and a polyester chain-containing monomer satisfying $0 \leq SP(M)-SP(E) \leq 2$ is preferably used. Both the solubility parameter values are close to each other, and thus it is possible to reliably obtain an action of facilitating the plasticity of the binder resin by the crystalline ester compound, and to thereby obtain extremely excellent low-temperature fixing property.

In contrast, when the value of SP(M)−SP(E) is significantly high, the crystalline ester compound has a low affinity for the specific styrene-acrylic resin and thus compatibility is not obtained, and moreover, a large amount thereof is present on the surface of the toner particles due to high polarity, with the result that it may not be possible to obtain sufficient heat-resistant storability and charging stability. In addition, even when the value of SP(M)−SP(E) is significantly low or negative, the crystalline ester compound has a low affinity for the specific styrene-acrylic resin and thus it is not possible to obtain compatibility, and moreover, since it is localized within the toner particles, it may not be possible to obtain the effect of facilitating the plasticity.

Furthermore, although it depends on SP(E) of a crystalline polyester resin used or the composition of another monomer forming the binder resin, the solubility parameter value SP(M) is preferably 8.5 to 12.5, and is more preferably 9.5 to 10.5. This is probably because, although it is difficult to simply consider compatibility between polymers with the SP value, and it is difficult to reach a conclusion since the polyester chain-containing monomer is considered to be in a state of being bound to the binder resin, the fact that the SP value of the entire binder resin and the value of SP(M) are close to each other allows the polyester chain-containing structural unit to be uniformly distributed in the binder resin. Therefore, a high affinity for the crystalline ester compound is exhibited, these become compatible at the time of heat fixing, and the effect of facilitating the plasticity of the binder resin in the present invention is enhanced.

In the present invention, the solubility parameter value (SP value: $(cal/cm^3)^{1/2}$) is a solubility parameter value at 25° C., is a specific value of a substance, and is a useful standard for predicting the solubility of the substance. The higher the SP value is, the higher the polarity is, whereas the lower the value is, the lower the polarity is. When two types of substances are mixed, the lower the difference between their SP values is, the higher the solubility is.

A polyester chain-containing structural unit content in the specific styrene-acrylic resin, that is, a ratio of the polyester chain-containing monomer thereto, is preferably 2 to 12% by mass and is more preferably 3 to 8% by mass.

The polyester chain-containing structural unit content in the specific styrene-acrylic resin falls within the above-described range, and thus the crystalline ester compound reliably has a high affinity for the specific styrene-acrylic resin, these become compatible at the time of heat fixing and it is possible to reliably obtain the effect of facilitating the plasticity of the binder resin. In contrast, when the polyester chain-containing structural unit content in the specific styrene-acrylic resin is significantly high, the glass-transition temperature of the binder resin is low, and it may not be possible to obtain sufficient heat-resistant storability. In addition, when the polyester chain-containing structural unit content in the specific styrene-acrylic resin is significantly low, it may not be possible to sufficiently obtain the effect of facilitating the plasticity by the polyester chain, and thus it may not be possible to sufficiently obtain low-temperature fixing property.

Another monomer used for the formation of the specific styrene-acrylic resin is not particularly limited as long as it can copolymerize with the polyester chain-containing monomer to thereby form a styrene-acrylic resin, and examples thereof include:

Styrene and its Derivatives styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecyl styrene, their derivatives and the like. Among these, styrene is used preferably.

Methacrylic Acid, Methacrylic Ester and their Derivatives methacrylic acid, methyl methacrylate (MMA), ethyl methacrylate (EMA), n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethyl amino ethyl methacrylate, dimethyl amino ethyl methacrylate, their derivatives and the like.

Acrylic Acid, Acrylic Ester and their Derivatives acrylic acid, methyl acrylate, ethyl acrylate, isopropyl acrylate, n-butyl acrylate, t-butyl acrylate, isobutyl acrylate, n-octyl acrylate, 2-ethylhexyl-acrylate, stearyl acrylate, lauryl acrylate, phenyl acrylate, their derivatives and the like. Among them, n-butyl acrylate is preferably used.

They can be used alone or in combination of two or more of them.

In addition, the following vinyl polymerizable monomers can also be used together with the styrene monomers and/or the (meth)acrylic monomer described above.

Olefins ethylene, propylene, isobutylene and the like

Vinyl Esters

Vinyl propionate, vinyl acetate, vinyl benzoate and the like

Vinyl Ethers vinyl methyl ether, vinyl ethyl ether and the like

Vinyl Ketones

Vinyl methyl ketone, vinyl ethyl ketone, vinyl hexyl ketone and like

N-Vinyl Compounds

N-vinyl carbazole, N-vinyl indole, N-vinyl pyrrolidone and the like

Others vinyl compounds such as vinyl naphthalene and vinyl pyridine and acrylic acid such as acrylonitrile, methacrylonitrile and acrylamide or methacrylic acid derivatives Furthermore, the following polymerizable monomers having an ionic dissociative group such as a carboxyl group or a phosphate group are preferably used together with the styrene monomers and/or the (meth)acrylic monomer described above.

Polymerizable Monomer Having a Carboxyl Group acrylic acid, methacrylic acid, α-ethyl acrylate, (meth) acrylic acid such as crotonic acid and α-alkyl derivative or β-alkyl derivative; unsaturated dicarboxylic acids such as fumaric acid, maleic acid, citraconic acid and itaconic acid; unsaturated dicarboxylic acid monoester derivatives such as mono-acryloyloxyethyl ester succinate, mono-acryloyloxyethyl ethylene ester succinate, mono-acryloyloxyethyl ester phthalate, mono-methacryloyloxyethyl ester phthalate and the like Polymerizable Monomer Having a Phosphate Group Acidophosphooxyethyl Methacrylate and the Like Furthermore, the following polyfunctional vinyl groups are used together with the styrene monomers and/or the (meth)acrylic monomer described above, and thus the binder resin can be made to have a cross-linked structure.

Polyfunctional Vinyl ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate and the like The glass-transition temperature of the specific styrene-acrylic resin is preferably 20 to 50° C., and is more preferably 30 to 45° C.

The glass-transition temperature of the specific styrene-acrylic resin falls within the above-described range, and thus it is possible to reliably obtain low-temperature fixing property.

The glass-transition temperature of the specific styrene-acrylic resin was measured through the use of "Diamond DSC" (manufactured by PerkinElmer Co., Ltd.).

In a measurement procedure, 3.0 mg of a specimen (the specific styrene-acrylic resin) was sealed in an aluminum pan and was set in a holder. As a reference, an empty aluminum pan was used. The temperature control is performed through a heating-cooling-heating cycle under the measurement conditions of a measurement temperature of 0° C. to 200° C., a temperature increase rate of 10° C./min and a temperature decrease rate of 10° C./min. Analysis was performed on the basis of data in the 2nd heating, and the extension of a base line before the rise of a first endothermic peak and a tangential line representing the maximum inclination between the rising portion of the first peak and the top of the peak are drawn, and their intersection is shown as the glass transition point.

In addition, in order for the toner to have low-temperature fixing property, the softening point of the specific styrene-acrylic resin is preferably 80 to 120° C., and is more preferably 90 to 110° C.

The softening point of the specific styrene-acrylic resin is measured through the use of a flow tester described below.

Specifically, 1.1 g of the specific styrene-acrylic resin is first placed in a petri dish under an environment of 20° C. and 50% RH and then is leveled off. After being left for 12 hours or longer, pressurizing of the specific styrene-acrylic resin is performed using a press "SSP-10A" (manufactured by Shimadzu Corporation) at a pressure of 3,820 kg/cm$^2$ for 30 seconds, to thereby produce a cylindrical molded sample having a diameter of 1 cm, and then, the molded sample is placed in the flow tester "CFT-500D" (manufactured by Shimadzu Corporation) under an environment of 24° C. and 50% RH. Under the conditions of a load of 196 N (20 kgf), a start temperature of 60° C., a preheating time of 300 seconds, and a temperature increase rate of 6° C./min, the molded sample is extruded from the hole (1 mm diameter×1 mm) of a cylindrical die by using a piston having a diameter of 1 cm after completion of preheating. An offset method temperature $T_{offset}$ measured by a melting temperature measurement method of a temperature rising method with an offset value being set to 5 mm is used as the softening temperature of the specific styrene-acrylic resin.

Furthermore, the weight-average molecular weight (Mw) of the specific styrene-acrylic resin is preferably 10,000 to 50,000, and is more preferably 25,000 to 35,000.

The weight-average molecular weight (Mw) of the specific styrene-acrylic resin falls within the above-described range, and thus it is possible to reliably obtain low-temperature fixing property and fixing separation property. In contrast, when the weight-average molecular weight (Mw) of the specific styrene-acrylic resin is significantly high, it may not be possible to sufficiently obtain low-temperature fixing property. Moreover, when the weight-average molecular weight (Mw) of the specific styrene-acrylic resin is significantly low, it may not be possible to sufficiently obtain fixing separation property.

The weight-average molecular weight (Mw) of the specific styrene-acrylic resin is measured by gel permeation chromatography (GPC).

Specifically, the weight-average molecular weight (Mw) is measured using an apparatus "HLC-8220" (manufactured by TOSOH Corporation) and a column "TSK guard column+ TSK gel Super HZM-M three in series" (manufactured by TOSOH Corporation) in the flow of tetrahydrofuran (THF) used as a carrier solvent at a flow rate of 0.2 ml/min while the temperature of the column is held at 40° C. A specimen (the specific styrene-acrylic resin) is dissolved in THF at room temperature for 5 minutes by using an ultrasonic disperser so as to have a concentration of 1 mg/ml. Then, a specimen solution is obtained by treatment through a membrane filter having a pore size of 0.2 μm, and 10 μL of the specimen solution together with the above-described carrier solvent is injected into the apparatus. Detection is performed using a refractive index detector (RI detector), and the molecular weight distribution of the measurement specimen is calculated using a calibration curve determined using monodispersed polystyrene standard particles. Ten different types of polystyrene are used for the measurement of the calibration curve.

Other resin that may be contained in the binder resin of the toner of the present invention is preferably an amorphous polyester resin or the like, and examples thereof include a vinyl resin such as an olefin resin, a polyamide resin, a polycarbonate resin, a polyether resin, a polyvinyl acetate resin, a polysulfone resin, an epoxy resin, a polyurethane resin, a urea resin and the like. The other resins can be used alone or in combination of two or more of them.

A content of each of the other resins in the binder resin is preferably 0 to 80% by mass.

[Crystalline Ester Compound]

The crystalline ester compound contained in the toner particles of the present invention acts as a plasticizer mainly for the binder resin at the time of heat fixing depending on a height of compatibility between the crystal line ester compound and the polyester chain of the specific styrene-acrylic resin, and functions as a fixing aid that contributes to low-temperature fixing property.

As the crystalline ester compound, a crystalline ester compound having two or more ester bonds is preferably used, and specific examples thereof include a fatty acid diester compound, a crystalline polyester resin having three or more ester bonds and the like. Among them, a crystalline polyester resin having four or more ester bonds is preferably used probably because the number of ester bonds is large and thus the strong interaction with the polyester chain of the specific styrene-acrylic resin is obtained, and the strong compatibility at the time of heat fixing is obtained.

In the present invention, the crystalline ester compound is a compound that does not have a stepwise change in differential scanning calorimetry (DSC) but has a clear endothermic peak. Specifically, the clear endothermic peak means a peak in which, when a measurement is made at a temperature increase rate of 10° C./min in differential scanning calorimetry (DSC), the half-value width of an endothermic peak falls within a range of 15° C. or less.

Specific examples of a monoester compound include stearyl stearate, behenyl stearate, behenyl behenate, behenyl palmitate, arachidic acid behenyl, tetracosanoic acid stearyl, hexacosanoic acid stearyl and the like.

Specific examples of an aliphatic diester compound include distearyl adipic acid, ethylene glycol distearate, dibehenyl succinate, distearyl succinate, dibehenyl adipic acid, sebacic acid distearyl, ethylene glycol dibehenate, 1,4-butanediol distearate, 1,4-butanediol dibehenate, 1,6-hexanediol distearate, 1,6-hexanediol dibehenate and the like.

In addition, the crystalline polyester resin can be generated from, for example, a dicarboxylic acid component and a diol component. Furthermore, the crystalline polyester resin can also be generated using, a raw material, hydroxycarboxylic acid or a cyclic compound by intramolecular dehydration condensation.

As the dicarboxylic acid component, an aliphatic dicarboxylic acid is preferably used, and may be used together with an aromatic dicarboxylic acid. As the aliphatic dicarboxylic acid, a linear aliphatic dicarboxylic acid is preferably used. The dicarboxylic acid component is not limited to one type, and two or more types of the dicarboxylic acid components may be mixed and used. In addition, as the diol component, an aliphatic dial is preferably used and may contain a diol other than an aliphatic diol as necessary. The diol component is not limited to one type, and two or more types of the diol components may be mixed and used.

Examples of the aliphatic dicarboxylic acid include oxalic acid, malonic acid, succinic acid, glutaric acid, adipic acid, pimelic acid, suberic acid, azerin acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid and the like. Their lower alkyl esters and acid anhydrides can also be used.

Examples of the aromatic dicarboxylic acid that can be used together with the aliphatic dicarboxylic acid include terephthalic acid, isophthalic acid, orthophthalic acid, t-butyl isophthalic acid, 2,6-naphthalene dicarboxylic acid, 4,4'-biphenyl dicarboxylic acid and the like. Among them, terephthalic acid, isophthalic acid and t-butyl isophthalic acid are preferably used from the viewpoint of ease of availability and ease of emulsifiability.

The amount of aromatic dicarboxylic acid to be used is preferably 20 constituent mole % or less when the entire diarboxylic acid component for forming the crystalline polyester resin is assumed to be 100 constituent mole %, is more preferably 10 constituent mole % or less and is particularly preferably 5 constituent mole % or less. The amount of aromatic dicarboxylic acid to be used is set to 20 constituent mole % or less, and thus it is possible to ensure the crystallinity of the crystalline polyester resin.

Examples of the aliphatic dial include ethylene glycol, 1,3-propanediol, 1,4-butanediol, 1,5-pentanediol, 1,6-hexanediol, 1,7-heptanediol, 1,8-octanediol, 1,9-nonanediol, 1,10-dodecanediol, 1,11-undecanediol, 1,12-dodecanediol, 1,13-tridecanediol, 1,14-tetradecanediol, 1,18-octadecanediol, 1,20-eicosanoic acid dial and the like. Among them, ethylene glycol, 1,4-butanediol, 1,6-hexanediol, 1,9-nonanediol and 1,10-decanediol are preferably used.

Examples of diols other than the aliphatic diol include a dial having a double bond, a diol having a sulfonic acid group and the like, and specific examples thereof include 2-butene-1,4-diol, 3-hexene-1,6-diol, 4-octene-1,8-diol and the like.

An aliphatic diol content in the diol component for forming the crystalline polyester resin is preferably 80 constituent mole % or more and is more preferably 90 constituent mole % or more. The aliphatic diol content in the diol component is set to 80 constituent mole % or more, and thus it is possible to ensure the crystallinity of the crystalline polyester resin.

In a usage ratio between the diol component and the dicarboxylic acid component described above, an equivalent ratio [OH]/[COOH] between the hydroxyl group [OH] of the diol component and the carboxyl group [COOH] of the dicarboxylic acid component is preferably 1.5/1 to 1/1.5, and is more preferably 1.2/1 to 1/1.2.

The usage ratio between the diol component and the dicarboxylic acid component falls within the above-described range, and thus it is possible to reliably obtain a crystalline polyester resin having a desired molecular weight.

The hydroxycarboxylic acids for generating the crystalline polyester resin include polyglycolic acid, 3-hydroxybutyric acid, 4-hydroxybutyric acid and 3-hydroxy valeric acid; examples of the cyclic compound include β-propiolactone, dimethyl-β-propiolactone, γ-butyrolactone, γ-valerolactone, γ-caprolactone, δ-valerolactone, δ-caprolactone, ϵ-caprolactone, p-dioxanone, 2-methylene-1,3,6-trioxocane and the like.

The weight-average molecular weight (Mw) of the crystalline polyester resin measured by gel permeation chromatography (GPC) is preferably 1,000 to 50,000, and is more preferably 2,000 to 30,000.

The weight-average molecular weight (Mw) of the crystalline polyester resin is measured using the crystalline polyester resin as a measurement specimen in the same manner as described above.

In the crystalline ester compound of the present invention, depending on the type of binder resin to be used, when its solubility parameter value ($(cal/cm^3)^{1/2}$) is assumed to be SP(E), the compound having SP(E) of 8.5 to 10.5 is preferably used, and the compound having SP(E) of 9.0 to 10.2 is more preferably used.

The solubility parameter value SP(E) of the crystalline ester compound falls within the above-described range, and thus it is possible to obtain a high affinity between the crystalline ester compound and the polyester chain and to reliably obtain the effect of facilitating the plasticity of the binder resin at the time of heat fixing. In contrast, when the solubility parameter value SP(E) of the crystalline ester compound is significantly high, the crystalline ester compound is present on the surface of the toner particles, and thus the toner may not have heat-resistant storability. In addition, when the solubility parameter value SP(E) of the crystalline ester compound is significantly low, there is a possibility that it is not possible to retain the crystalline ester compound in the binder resin to produce bleeding and thus it is not possible to obtain sufficient heat-resistant storability, or there is a possibility that it is not possible to sufficiently obtain the compatibility between the crystalline ester compound and the binder resin at the time of heat fixing.

The melting point of the crystalline ester compound is preferably 50 to 120° C., and is more preferably 60 to 90° C.

The melting point of the crystalline ester compound falls within the above-described range, and thus it is possible to reliably obtain low-temperature fixing property and fixing separation property. In contrast, when the melting point of the crystalline ester compound is significantly low, it may not be possible to satisfactorily obtain excellent fixing separation property, whereas, when the melting point of the crystalline ester compound is significantly high, it may not be possible to sufficient low-temperature fixing property.

Specifically, the melting point of the crystalline ester compound is measured, using "Diamond DSC" (manufactured by PerkinElmer Co., Ltd.) as a differential scanning calorimeter, under measurement conditions (temperature increase and cooling conditions) which undergo, in the following order, the first temperature increase process in which the temperature is increased from 0° C. to 200° C. at a temperature increase rate of 10° C./min, a cooling process in which the temperature is cooled from 200° C. to 0° C. at a cooling rate of 10° C./min and the second temperature increase process in which the temperature is increased from 0° C. to 200° C. at a temperature increase rate of 10° C./min. On the basis of a DSC curve obtained by this measurement, an endothermic peak top temperature derived from the crystalline ester compound in the first temperature increase process is assumed to be the melting point. In the measurement procedure, 3.0 mg of the crystalline ester compound was sealed in an aluminum pan and was set in a Diamond DSC sample holder. As a reference, an empty aluminum pan was used.

A crystalline ester compound content in the toner particles is preferably 1 to 30% by mass, and is more preferably 5 to 20% by mass.

The crystalline ester compound content falls within the above-described range, and thus it is possible to reliably obtain both sufficient low-temperature fixing property and eat-resistant storability. When the crystalline ester compound content is significantly high, the binder resin is significantly softened, and thus the heat-resistant storability of the toner may be degraded. When the crystalline ester compound content is significantly low, it may not be possible to obtain sufficient low-temperature fixing property.

[Wax]

in the toner particles of the present invention, a wax having a composition different from that of the crystalline ester compound, other than the binder resin and the crystalline ester compound is contained as an internal additive.

This wax functions as a mold release agent that facilitates fixing separation property and the like.

When the solubility parameter value of the wax described above is assumed to be SP(W), a wax preferably satisfies SP(W)<SP(E), and specifically, the difference between them is preferably 0.1 or more.

The wax and the crystalline ester compound satisfy the above-described relationship, and thus it is possible to reliably obtain both the mold release property by the wax and the effect of facilitating the plasticity of the binder resin by the crystalline ester compound.

Although the solubility parameter value SP(W) of the wax differs depending on the solubility parameter value SP(E) of the crystalline ester compound to be used together, specifically, it preferably falls within a range of 8.1 to 8.9, and it more preferably falls within a range of 8.1 to 8.7. The solubility parameter value SP(W) of the wax falls within the above-described range, and thus it is possible to achieve satisfactory mold release property at the time of heat fixing. In contrast, when the solubility parameter value SP(W) of the wax is significantly low, there is a possibility that it is not possible to retain the crystalline ester compound in the binder resin, thereby producing bleeding and thus it is not possible to obtain sufficient heat-resistant storability, or a possibility that an image failure is produced by contamination within the device, whereas, when the solubility parameter value SP(W) of the wax is significantly high, and a possibility that it is not possible to obtain sufficient mold release property and thus it is not possible to sufficiently obtain fixing separation property.

The melting point of the wax is preferably equal to or less than the melting point of the crystalline ester compound, and specifically, it preferably falls within a range of 50 to 120° C., and it more preferably falls within a range of 60 to 90° C.

Through the use of the wax whose melting point is equal to or less than the melting point of the crystalline ester compound, the wax first seeps at the time of heat fixing and then the crystalline ester compound melts to facilitate the plasticity of the binder resin, and thus it is possible to obtain excellent fixing separation property and hot offset resistance.

Through the use of the wax whose melting point falls within the above-described range, heat-resistant storability is ensured in the obtained toner and stable low-temperature fixing property is obtained. In contrast, when the melting point of the wax is significantly low, there is a possibility that bleeding is generated and thus it is not possible to obtain sufficient heat-resistant storability in the toner, whereas, when the melting point of the wax is significantly high, there is a possibility that it is not possible to melt the wax sufficiently ahead of the crystalline ester compound and thus it is not possible to satisfactorily obtain excellent fixing separation property.

In the measurement of the melting point of the crystalline ester compound described above, the measurement specimen is assumed to be the wax, and an endothermic peak top temperature derived from the wax in the second temperature increase process is assumed to be the melting point of the wax.

The wax is not particularly limited as long as it is different from the crystalline ester compound, and specific examples include: polyolefin waxes such as a polyethylene wax and a polypropylene wax; branched hydrocarbon waxes such as a microcrystalline wax; long chain hydrocarbon waxes such as a paraffin wax, a Sasol wax; dialkyl ketone waxes such as a distearyl ketone; carnauba wax; montan wax; ester waxes such as stearyl stearate, behenyl stearate, behenyl behenate, behenyl palmitate, arachidic acid behenyl, tetracosanoic acid stearyl, hexacosanoic acid stearyl, trimethylolpropane tribehenate, pentaerythritol tetra behenate, pentaerythritol diacetate dibehenate, glycerin tribehenate, 1,18-octadecanediol distearate, trimellitic acid tristearyl and distearyl maleate; amide waxes such as ethylenediamine behenyl amide, trimellitic acid tristearyl amide; and the like. They can be used alone or in combination of two or more of them.

Among them, a hydrocarbon wax is preferably used.

A wax content in the toner particles is preferably 1 to 30% by mass, and is more preferably 5 to 20% by mass. The wax content falls within the above-described range, and thus it is possible to sufficiently obtain fixing separation property. When the wax content is significantly high, the toner particles are significantly softened, and thus the heat-resistant storability of the toner may be degraded.

The total amount of the crystalline ester compound and the wax contained in the toner particles of the present invention is preferably 2 to 40% by mass, and is more preferably 5 to 30% by mass.

When the total amount of the crystalline ester compound and the wax contained therein is significantly low, it may not be possible to obtain sufficient mold release property and low-temperature fixing property, whereas, when the total amount of the crystalline ester compound and the wax contained therein is significantly high, it may not be possible to obtain sufficient heat-resistant storability in the toner because of the generation of bleeding.

In addition, the mass ratio A/B between the wax and the crystalline ester compound is preferably 30/70 to 80/20, and is more preferably 40/60 to 70/30.

When the mass ratio of the wax to the crystalline ester compound is significantly low, it may not be possible to sufficiently obtain mold release property. When the mass ratio of the wax to the crystalline ester compound is significantly high, it may not be possible to obtain sufficient low-temperature fixing property.

In the toner particles of the present invention, other than the binder resin and the crystalline ester compound, internal additives such as a colorant, a charge control agent and the like may be contained as necessary.

[Colorant]

As a colorant, commonly known dyes and pigments can be used.

As a colorant for obtaining a black toner, known various types of colorants such as carbon blacks including a furnace black and a channel black, magnetic materials including a magnetite and a ferrite, an inorganic pigment containing a dye a non-magnetic iron oxide can be arbitrarily used.

As a colorant for obtaining a color toner, known colorants such as dyes and organic pigments can be arbitrarily used, and specifically, examples of the organic pigment include C.I. Pigment Red: 5, 48:1, 53:1, 57:1, 81:4, 1.22, 1.39, 1.44, 149, 266, 177, 178, 222, 238 and 269, C.I. Pigment Yellow: 14, 17, 74, 93, 94, 138, 155, 180 and 185, C.I. Pigment Orange: 31 and 43 and C.I. Pigment Blue: 15:3, 60 and 76. Examples of the dye include C.I. Solvent red: 1, 49, 52, 58, 68, 11 and 122, C.I. Solvent Yellow: 19, 44, 77, 79, 81, 82, 93, 98, 103, 104, 112 and 162, C.I. Solvent Blue: 25, 36, 69, 70, 93 and 95, and the like.

Colorants for obtaining the toner of each color can be used alone or in combination of two or more of them, for each color.

A colorant content in the toner particles is preferably 1 to 10% by mass, and is more preferably 2 to 8% by mass.

[Charge Control Agent]

As the charge control agent, known various types of compounds can be used.

A charge control agent content in the toner particles with respect to the binder resin is normally 0.1 to 10% by mass, and preferably 0.5 to 5% by mass.

[Softening Point of the Toner]

In order for the toner to have low-temperature fixing property, the softening point of the toner is preferably 80 to 120° C. and is more preferably 90 to 110° C.

The softening point of the toner falls within the above-described range, and thus it is possible to reliably obtain low-temperature fixing property and fixing separation property.

The softening point of the toner is measured using toner as a specimen in the same manner as described above.

[Average Particle Diameter of the Toner]

The average particle diameter of the toner according to the present invention is preferably 3 to 9 μm, and is more preferably 3 to 8 μm, for example, in terms of a volume-based median diameter. For example, when the toner is manufactured by adopting an emulsification aggregation method, which will be described later, it is possible to control the particle diameter depending on the concentration of a aggregating agent to be used, the amount of organic solvent to be added, a fusion time and the composition of a polymer.

The volume-based median diameter falls within the above-described range, and thus the transfer efficiency is increased, and the quality of a halftone image is enhanced, with the result that the image quality of fine lines and dots is enhanced.

The volume-based median diameter of the toner is measured and calculated using a measuring device in which a computer system into which data processing software "Software V3.51" is installed is connected to "Multisizer 3" (manufactured by Beckman Coulter, Inc.).

Specifically, 0.02 g of a specimen (the toner) is added to 20 mL of a surfactant solution (for example, a surfactant solution obtained by diluting a neutral detergent containing a surfactant component, with pure water, to 10 times for the purpose of dispersing the toner particles) to cause the specimen to be spread therein, and then ultrasonic dispersion is performed for 1 minute to prepare a toner dispersion liquid. This resultant toner dispersion liquid is added, with a pipette, to a beaker containing "ISOTON TI" (manufactured by Beckman Coulter, Inc.) within a sample stand until the concentration displayed in the measuring device reaches 8%. Here, by using the above-described concentration range, a reproducible measurement value can be obtained. Then, in the measuring device, the measurement number of particles to be counted is set to 25,000, and the diameter of an aperture is set to 50 μm. The range of measurement from 1 to 30 μm is divided into 256 sections, and a frequency value is calculated. The particle size when a cumulative volume fraction cumulated from the largest volume fraction is 50% is used as the volume-based median diameter.

[Average Degree of Circularity of the Toner]

From the viewpoint of enhancement of the transfer efficiency, the average degree of circularity of the toner according to the present invention is preferably 0.930 to 1.000, and is more preferably 0.950 to 0.995.

In the present invention, the average degree of circularity of the toner is measured through the use of "FPIA-2100" (manufactured by Sysmex Corporation).

Specifically, a specimen (the toner) is spread in an aqueous solution containing a surfactant, and is dispersed by being subjected to ultrasonic dispersion processing for 1 minute, thereafter shooting is performed with "FPIA-2100" (manufactured by Sysmex Corporation) in a measurement condition HPF (high magnification imaging) mode at an appropriate concentration in which the HPF detection number is 3,000 to 10,000, the degree of circularity of each toner particle is calculated according to the following formula (T), the degrees of circularity of the toner particles are added and the resulting value is divided by the total number of toner particles, with the result that the average degree of circularity of the toner is measured.

Degree of circularity=(Circumference of a circle having the same projection area as a particle image)/(Circumference of a particle projection image) Formula (T)

[Method of Manufacturing the Toner]

A method of manufacturing the toner of the present invention is not particularly limited, and examples thereof include known methods such as a kneading-pulverizing method, a suspension polymerization method, an emulsion aggregation method, a dissolution suspension method, a polyester elongation method and a dispersion polymerization method.

Among them, it is preferable to adopt the emulsion aggregation method from the viewpoint of the uniformity of particle diameters which is highly advantageous in high image quality and the high stability of charging, the controllability of the shape and the ease of formation of a core shell structure.

The emulsion aggregation method is a method in which a dispersion liquid of minute particles (hereinafter also referred to as "resin particles") of the binder resin dispersed by a surfactant and a dispersion stabilizer is mixed, as necessary, with a dispersion liquid of toner particle constituent components such as the minute particles of the colorant, and is aggregated by addition of an aggregation agent until a desired toner particle diameter is obtained, thereafter or at the same time when the aggregation occurs, the resin minute particles are fused, the shape is controlled and thus the toner particles are formed.

Here, as the resin minute particles, composite particles formed with a plurality of layers composed of two or more layers of resins having different compositions can be used.

The resin minute particles can be manufactured by, for example, an emulsion polymerization method, a mini-emulsion polymerization method or a phase-transfer emulsification method or can be manufactured by combining several manufacturing methods. When an internal additive is contained in the resin minute particles, the mini-emulsion polymerization method, among them, is preferably used.

When an internal additive is contained in the resin minute particles, the resin minute particles may contain the internal additive or a dispersion liquid of internal additive minute particles consisting only of the internal additive may be prepared separately and the internal additive minute particles may be aggregated together when the resin minute particles are aggregated.

In addition, when the toner particles are configured to have a core shell structure, the resin minute particles having different compositions are preferably added and aggregated with different timing at the time of aggregation.

A method of introducing a specific styrene-acrylic resin into the toner particles of the present invention will be specifically described below.

In the emulsion aggregation method, the specific styrene-acrylic resin has only to be introduced into any of the aggregated resin minute particles, and when the resin minute particles are formed with composite particles having two or more layers, the specific styrene-acrylic resin may be introduced into any of the layers of the composite particles.

In the emulsion aggregation method, together with the resin minute particles into which the specific styrene-acrylic resin has been introduced, the resin minute particles formed with a resin not including the specific styrene-acrylic resin may be aggregated. In addition, the resin minute particles into which the specific styrene-acrylic resin has been introduced may be added during the aggregation with any timing from the beginning to the end of the aggregation, or the addition may be performed by being divided into a plurality of times.

Preferably, in the kneading-pulverizing method, the specific styrene-acrylic resin may be kneaded alone or together with another resin.

In addition, as a method of introducing the crystalline ester compound into the toner particles of the present invention, for example, when the emulsion aggregation method is used to manufacture the toner, the mini-emulsion polymerization method of introducing the crystalline ester compound into the aggregated resin minute particles is preferably used, whereas, when the resin minute particles are formed with the composite particles having two or more layers, the crystalline ester compound may be introduced into any of the layers of the composite particles.

Furthermore, the minute particles of the crystalline ester compound are produced by the phase-transfer emulsification method or the like, and are aggregated together with the resin minute particles, and thus the crystalline ester compound can also be introduced.

[External Additives]

Although the toner particles of the present invention can be used as toner particles without being processed, from the viewpoint of enhancing the charging performance, the flowability or the cleaning performance of the tone, particles such as known inorganic minute particles and organic minute particles and a lubricant can be added as external additives to the surface of the toner particles.

The inorganic minute particles preferably include inorganic minute particles of silica, titania, alumina, strontium titanate and the like.

These inorganic minute particles may be subjected to hydrophobization processing, as necessary.

As the organic minute particles, spherical organic minute particles having a number-average primary particle diameter of about 10 to 2000 nm can be used. Specifically, organic minute particles of a homopolymer such as styrene or methyl methacrylate or of a copolymer thereof can be used.

The lubricant is used in order to further enhance the cleaning performance and transferability, and examples of the lubricant include metal salts of higher fatty acids such as: salts of zinc, aluminum, copper, magnesium, calcium and the like of stearic acid; salts of zinc, manganese, iron, copper, magnesium and the like of oleic acid; salts of zinc, copper, magnesium, calcium and the like of palmitic acid; salts of zinc, calcium and the like of linoleic acid; and salts of zinc, calcium and the like of ricinoleic acid. A combination of various types of these external additives may be used.

The amount of external additive added to the toner particles is 0.1 to 10.0% by mass.

Examples of a method of adding the external additive include methods of adding the external additive by using known various types of mixing devices such as a tubular mixer, a Henschel mixer, a Nautamixer and a V-type mixer.

[Developer]

The toner of the present invention can be used as a magnetic or non-magnetic one-component developer, but may also be mixed with a carrier to be used as a two-component developer.

When the toner is used as a two-component developer, the amount of the toner mixed with the carrier is preferably 2 to 10% by mass.

No particular limitation is imposed on a mixer used to mix the toner and the carrier, and examples of the mixer include a Nautamixer and W-cone and V-type mixers.

In terms of the volume-based median diameter, the average particle diameter of the carrier is preferably 10 to 60 μm.

In the present invention, the volume-based median diameter of the carrier can be measured typically with a laser diffraction-type particle size distribution measuring device "HELOS" (manufactured by SYMPATEC Corp.) provided with a typical wet dispersing device.

Furthermore, as the carrier, a coat carrier in which a magnetic particle is used as a core material (core) and whose surface is coated with a resin is preferably used. The resin used for coating the core material is not particularly limited, and various types of resins can be used. For example, for a positively charged toner, a fluorine resin, a fluorine-acrylic acid resin, a silicone resin, a modified silicone resin and the like can be used, and specifically, a condensation-type silicone resin is preferably used. Furthermore, for example, for a negatively charged toner, a styrene-acrylic resin, a mixture resin of a styrene-acrylic resin and a melamine resin, its curing resin, a silicone resin, a modified silicone resin, an epoxy resin, a polyester resin, a urethane resin, a polyethylene resin and the like can be used. Among them, a mixture resin of a styrene-acrylic resin and a melamine resin, its curing resin or a condensation-type silicone resin is preferably used.

When the toner of the present invention is used as a two-component developer, the two-component developer can also be formed by further adding, to the toner and the carrier, as necessary, a charge control agent, an adhesion enhancement agent, a primer processing agent, a resistance control agent or the like.

[Image Forming Device]

The toner of the present invention can be used in a general image forming method of an electrophotograpic method. As an image forming device for performing this type of image forming method, an image forming device can be used that includes: a photosensitive member that is, for example, an electrostatic latent image carrier; charging means that per forms corona discharge having the same polarity as the toner, to thereby apply a uniform potential on the surface of the photoreceptor; exposure means that expose, based on image data, an image onto the surface of the uniformly charged photoreceptor, to thereby form an electrostatic latent image; development means that transports the toner to the surface of the photoreceptor and visualizes the electrostatic latent image to form the toner image; transfer means that transfers, as necessary, the toner image through an intermediate transfer body to an image support; and fixing means that thermally fixes the toner image on the image support.

In addition, the toner of the present invention can be suitably used as a toner of a relatively low-temperature in which a fixing temperature (the surface temperature of a fixing member) is 100 to 200° C.

According to the toner described above, the polyester chain-containing structural unit is contained in the specific styrene-acrylic resin forming the binder resin of the toner, and thus it is possible to obtain excellent low-temperature fixing property and long-term stability of charging.

As described above, although the embodiment of the present invention has been described, the embodiment of the present invention is not limited to the examples described above, and various modifications are possible.

EXAMPLES

Hereinafter, although specific examples of the present invention will be described, the present invention is not limited to these examples.

The molecular weight and the melting point of the crystalline polyester resin were measured in the same manner as described above.

Synthesis Example A1 of the Crystalline Polyester Resin 300 g of 1,10-decanediol, 250 g of 1,10-decanedicarboxylic acid and a catalyst $Ti(OBu)_4$ (0.014% by mass with respect to the carboxylic acid component) were put into a three-necked flask, and then the pressure within the container was reduced by a pressure reduction operation. Furthermore, nitrogen gas was used to keep the container under an inert atmosphere, and reflux was performed at 180° C. for 6 hours by mechanical agitation. Thereafter, an unreacted monomer component was removed by distillation under reduced pressure, the temperature was gradually increased to 220° C. and agitation was performed for 12 hours. When a viscous state was reached, cooling was performed, and thus a crystalline polyester resin [A1] was obtained.

The obtained crystalline polyester resin [A1] had a weight-average molecular weight (Mw) of 17,600 and a melting point of 82° C.

Synthesis Examples A2 to A5 of the Crystalline Polyester Resin

Crystalline polyester resins [A2] to [A5] were obtained in the same manner as synthesis example A1 of the crystalline polyester resin except that, as acid components and alcohol components, ones shown in the following Table 1 were used.

The weight-average molecular weight (Mw), the melting point and the SP value of these resins are shown in Table 1.

[Crystalline Polyester Resin [A6]]

As the crystalline polyester resin [A6], a polycaprolactone "Placcel H1P" (manufactured by Daicel Corporation), which is a polymer of ϵ-caprolactone, was used.

Synthesis Example of Distearyl Adipic Acid 64 parts by mass of adipic acid, 236 parts by mass of stearyl alcohol and 0.5 part by mass of dihydroxy bis titanium (triethanolaminate) serving as a condensation catalyst were put into a reaction container provided with a cooling tube, a thermometer, an agitator, a dehydration device and a nitrogen introduction tube were caused to react for 2 hours while generated water was evaporated away and were further caused to react under a reduced pressure of 5 to 20 mm Hg for 3 hours, with the result that distearyl adipic acid was obtained.

[Ethylene Glycol Distearate]

As ethylene glycol distearate, "Emanon 3201M-V" (manufactured by Kao Corporation) was used.

TABLE 1

| Crystalline ester compound | | | | | Melting point | |
|---|---|---|---|---|---|---|
| No. | Compound name | Acid component | Alcohol component | Mw | (° C.) | CP value |
| [A1] | Crystalline polyester resin | 1,10-decanecarboxylic acid | 1,10-decanediol | 17,600 | 82 | 9.4 |
| [A2] | Crystalline polyester resin | Adipic acid | Diethylene glycol | 11,000 | 68 | 10.4 |
| [A3] | Crystalline polyester resin | 1,10-decanecarboxylic acid | 1,8-octanediol | 9,500 | 72 | 9.5 |
| [A4] | Crystalline polyester resin | 1,10-decanecarboxylic acid | Diethylene glycol | 10,500 | 80 | 9.8 |
| [A5] | Crystalline polyester resin | Adipic acid | 1,6-hexanediol | 14,500 | 85 | 10.1 |
| [A6] | Crystalline polyester resin | ϵ-caprolactone | | 10,200 | 60 | 10.2 |
| [A7] | Behenyl behenate | Behenic acid | Behenyl alcohol | 649 | 71 | 8.6 |
| [A8] | Distearyl adipic acid | Adipic acid | Stearyl acohol | 648 | 72 | 8.8 |
| [A9] | Ethylene glycol distearate | Stearic acid | Ethylene glycol | 592 | 75 | 8.9 |

Example 1

Production Example 1 of the Toner (1) Preparation of Dispersion Liquid of Core Resin Minute Particles (First Stage Polymerization)

4 g of polyoxyethylene (2) dodecyl ether sodium sulfate and 3000 g of ion exchange water were put into a 5 L reaction container equipped with an agitation device, a temperature sensor, a cooling tube and a nitrogen introduction device, and the internal temperature was increased to 80° C. while they were being agitated at an agitation rate of 230 rpm under a nitrogen current. After the increase of the temperature, a solution obtained by dissolving 10 g of potassium persulfate in 200 g of ion exchange water was added, the liquid temperature was changed to be 75° C., a monomer mixture liquid composed of 568 g of styrene, 164 g of n-butyl acrylate and 68 g of methacrylic acid was dripped over 1 hour and then the resulting solution was polymerized by being heated and agitated at 75° C. for 2 hours, with the result that a dispersion liquid of resin particles [b1] was prepared.

(Second Stage Polymerization)

A solution obtained by dissolving 2 g of polyoxyethylene (2) dodecyl ether sodium sulfate in 3000 g of ion exchange water was put into a 5 L reaction container equipped with an agitation device, a temperature sensor, a cooling tube and a nitrogen introduction device, the temperature was increased to 80° C., a solution obtained by dissolving 42 g (in terms of solid content) of the above-described resin particles [b1], 35 g of a wax "HNP-0190" (manufactured by Nippon Seiro Co., Ltd.) and 70 g of the above-described crystalline polyester resin [A1] in a monomer solution composed of 195 g of styrene, 91 g of n-butyl acrylate, 20 g of methacrylic acid and 3 g of n-octylmercaptan at 80° C. was added and then the resulting solution was mixed and dispersed for 1 hour with a mechanical dispersion machine "CLEARMIX" (manufactured by M Technique Co., Ltd.) having a circulation path, with the result that a dispersion liquid containing emulsified particles (oil droplets) was prepared.

Then, an initiator solution obtained by dissolving 5 g of potassium persulfate in 100 g of ion exchange water was added to the dispersion liquid, and this method was polymerized by being heated and agitated at 80° C. over 1 hour, with the result that a dispersion liquid of resin particles [b2] was prepared.

(Third Stage Polymerization)

Furthermore, a solution obtained by dissolving 10 g of potassium persulfate in 200 g of ion exchange water was added to the dispersion liquid of the resin particles [b2], and a monomer mixture liquid composed of 315 g of styrene, 1.45 g of n-butyl acrylate, 25 g of the polyester chain-containing monomer (1-1) (see Table 1), 32 g of methacrylic acid and 6 g of n-octylmercaptan was dripped over 1 hour under a temperature condition of 80° C. After the dripping, the resulting solution was polymerized by being heated and agitated for 2 hours, and was cooled to 28° C., with the result that a dispersion liquid of core resin particles [C1] was obtained.

(2) Preparation of Dispersion Liquid of Shell Resin Minute Particles

A surfactant solution obtained by dissolving 2.0 g of polyoxyethylene dodecyl ether sodium sulfate in 3000 g of ion exchange water was put into a reaction container equipped with an agitation device, a temperature sensor, a cooling tube and a nitrogen introduction device, and the internal temperature was increased to 80° C. while it was being agitated at an agitation rate of 230 rpm under a nitrogen current.

An initiator solution obtained by dissolving 10 g of potassium persulfate in 200 g of ion exchange water was added to the solution mentioned above, and a polymerizable monomer mixture liquid obtained by mixing a compound including 564 g of styrene, 140 g of n-butyl acrylate, 96 g of methacrylic acid and 12 g of n-octylmercaptan was dripped over 3 hours. Then after the dripping, this system was polymerized by being heated and agitated at 80° C. over 1 with the result that a dispersion liquid of shell resin particles [S1] was obtained.

(3) Preparation of Dispersion Liquid of Colorant Minute Particles 90 g of dodecyl sodium sulfate was dissolved in 1600 g of ion exchange water while they were being agitated. While this solution was being agitated, 420 g of a carbon black "Regal 330R" (manufactured by Cabot Corporation) was gradually added, and then dispersion processing was performed with an agitation device "CLEARMIX" (manufactured by M Technique Co., Ltd.), with the result that a dispersion liquid [Bk] of colorant minute particles was prepared.

The diameter of the colorant minute particles in the dispersion liquid [Bk] of colorant minute particles was measured through the use of an electrophoretic light scattering photometer "ELS-800" (manufactured by Otsuka Electronics Co., Ltd.), and the resultant diameter was 110 nm.

(4) Formation of Toner Particles (Aggregation/Fusion Process)

360 g of the dispersion liquid (in terms of solid content) of the core resin particles [C1], 1100 g of ion exchange water and 200 g of the dispersion liquid [Bk] of colorant minute particles were put into a 5 L reaction container equipped with an agitation device, a temperature sensor, a cooling tube and a nitrogen introduction device, the liquid temperature was adjusted to be 30° C. and then the pH was adjusted to be 10 by addition of 5 N of aqueous sodium hydroxide. Then, an aqueous solution obtained by dissolving 60 g of magnesium chloride in 60 g of ion exchange water was added at 30° C. for 10 minutes while being agitated. The temperature was held for 3 minutes, then the temperature started to be increased, the temperature of this system was increased to 85° C. over 60 minutes and a particle growth reaction was continued while the temperature of 85° C. was being held. In this state, the diameter of associated particles was measured through the use of "Coulter Multisizer 3" (manufactured by Beckman Coulter, Inc.), when the volume-based median diameter reached 6 μm, the addition of an aqueous solution obtained by dissolving 40 g of magnesium chloride in 160 g of ion exchange water was performed to stop the growth of the particles and furthermore heating and agitation were performed at a liquid temperature of 80° C. over 1 hour in a maturation process, to thereby progress fusion between the particles, with the result that core particles [1] were formed.

(Shelling Process)

Then, 40 g of the shell resin particles [S1] (in terms of solid content) was added, agitation was continued at 80° C. over 1 hour and the shell resin particles [S1] were fused to the surface of the core particles [1], with the result that a shell layer was formed. Here, an aqueous solution obtained by dissolving 150 g of sodium chloride in 600 g of ion exchange water was added, maturation processing was performed at 80° C., and the temperature was cooled to 300 when a desired circularity was reached.

(Washing/Drying Process)

The generated particles were subjected to solid-liquid separation with a basket type centrifugal separator "MARK III Model No. 60×40" (manufactured by Matsumoto Machine Co., Ltd.), and a wet cake of toner base particles was formed. This wet cake was washed with ion exchange water of 40° C. until the electric conductivity of a filtrate reaches 5 μS/cm in the basket type centrifugal separator, was then transferred to "Flash jet dryer" (manufactured by Seishin Enterprise Co., Ltd.) and was dried until the amount of water reaches 0.5% by mass, with the result that toner base particles [1] were obtained.

(External Additive Addition Process)

1% by mass of hydrophobic silica (number-average primary particle diameter=12 nm) and 0.3% by mass of hydrophobic titania (number-average primary particle diameter=20 nm) were added to the toner base particles [1], and resultant substance was mixed with a Henschel mixer, with the result that toner [1] was produced.

Examples 2 to 32

Comparative Examples 1 to 4

Production Examples 2 to 36 of the Toner

Toners [2] to [36] were produced in the same manner as in the Production Example 1 of the toner except that, instead of the "polyester chain-containing monomer (1-1)", polyester chain-containing monomers shown in Tables 2 to 4 were used in accordance with Table 5, and that, as the crystalline ester compound, the crystalline ester compound shown in Table 1 was used in accordance with Table 5.

Meanwhile, the melting point of the wax "HNP-0190" (manufactured by Nippon Seiro Co., Ltd.) is 81° C., and its SP value is 8.1.

TABLE 2

| Polyester chain-containing monomer No. | General formula | Structure —$R^1$ | —$X^1$— | —$R^2$ | —$R^3$— | m | n | SP value |
|---|---|---|---|---|---|---|---|---|
| (1-1) | (1) | —$CH_3$ | —CO— | —$CH_3$ | —$(CH_2)_2$— | 5 | 2 | 10.3 |
| (1-2) | (1) | —$CH_3$ | — | —H | —$(CH_2)_2$— | 5 | 5 | 10.8 |
| (1-3) | (1) | —$CH_3$ | —CO— | —$CH_3$ | —$(CH_2)_2$— | 5 | 5 | 10.3 |
| (1-4) | (1) | —$CH_3$ | —CO— | —$CH_3$ | —$(CH_2)_2$— | 5 | 10 | 10.2 |
| (1-5) | (1) | —$CH_3$ | —CO— | —$CH_3$ | —$(CH_2)_2$— | 5 | 20 | 10.2 |
| (1-6) | (1) | —$CH_3$ | —CO— | —$C_6H_5$ | —$(CH_2)_2$— | 5 | 5 | 10.4 |
| (1-7) | (1) | —$CH_3$ | —CO— | —$CH_3$ | —$(CH_2)_2$— | 4 | 5 | 10.5 |
| (1-8) | (1) | —$CH_3$ | —CO— | —$CH_3$ | —$(CH_2)_2$— | 6 | 5 | 10.1 |
| (1-9) | (1) | —H | —CO— | —$CH_3$ | —$(CH_2)_2$— | 5 | 5 | 10.3 |
| (1-10) | (1) | —H | —CO— | —$CH_3$ | —$(CH_2)_2$— | 5 | 10 | 10.3 |

TABLE 3

| Polyester chain-containing monomer No. | General formula | Structure —$R^4$ | —$X^2$— | —$R^5$ | —$R^6$— | p | SP value |
|---|---|---|---|---|---|---|---|
| (2-1) | (2) | —$CH_3$ | —CO— | —$CH_3$ | —$(CH_2)_2$— | 2 | 11.1 |
| (2-2) | (2) | —$CH_3$ | —CO— | —$CH_3$ | —$(CH_2)_2$— | 5 | 11.1 |
| (2-3) | (2) | —$CH_3$ | —CO— | —$CH_3$ | —$(CH_2)_2$— | 10 | 11.1 |
| (2-4) | (2) | —$CH_3$ | —CO— | —$CH_3$ | —$(CH_2)_2$— | 20 | 11.1 |

TABLE 4

| Polyester chain-containing monomer No. | General formula | Structure —$R^7$ | —$R^8$ | —$R^9$— | s | | SP value |
|---|---|---|---|---|---|---|---|
| (3-1) | (3) | —$CH_3$ | —$CH_3$ | — | 5 | 5 | 10.1 |
| (3-2) | (3) | —$CH_3$ | —$CH_3$ | — | 5 | 10 | 10.2 |
| (3-3) | (3) | —$CH_3$ | —$C_6H_5$ | — | 5 | 10 | 10.3 |
| (3-4) | (3) | —$CH_3$ | —$C_{12}H_{25}$ | — | 5 | 10 | 9.9 |

TABLE 5

| | Toner No. | Polyester chain-containing monomer No. | Crystalline ester compound No. |
|---|---|---|---|
| Example 1 | 1 | (1-1) | Crystalline polyester resin [A-1] |
| Example 2 | 2 | (1-2) | Crystalline polyester resin [A-1] |
| Example 3 | 3 | (1-3) | Crystalline polyester resin [A-1] |
| Example 4 | 4 | (1-4) | Crystalline polyester resin [A-1] |
| Example 5 | 5 | (1-5) | Crystalline polyester resin [A-1] |
| Example 6 | 6 | (1-6) | Crystalline polyester resin [A-1] |
| Example 7 | 7 | (1-7) | Crystalline polyester resin [A-1] |
| Example 8 | 8 | (1-8) | Crystalline polyester resin [A-1] |
| Example 9 | 9 | (1-9) | Crystalline polyester resin [A-1] |
| Example 10 | 10 | (1-10) | Crystalline polyester resin [A-1] |
| Example 11 | 11 | (2-1) | Crystalline polyester resin [A-1] |
| Example 12 | 12 | (2-2) | Crystalline polyester resin [A-1] |
| Example 13 | 13 | (2-3) | Crystalline polyester resin [A-1] |
| Example 14 | 14 | (2-4) | Crystalline polyester resin [A-1] |
| Example 15 | 15 | (3-1) | Crystalline polyester resin [A-1] |
| Example 16 | 16 | (3-2) | Crystalline polyester resin [A-1] |
| Example 17 | 17 | (3-3) | Crystalline polyester resin [A-1] |
| Example 18 | 18 | (3-4) | Crystalline polyester resin [A-1] |
| Example 19 | 19 | (1-3) | Crystalline polyester resin [A-2] |
| Example 20 | 20 | (1-3) | Crystalline polyester resin [A-3] |
| Example 21 | 21 | (1-3) | Crystalline polyester resin [A-4] |
| Example 22 | 22 | (1-3) | Crystalline polyester resin [A-5] |
| Example 23 | 23 | (1-3) | Crystalline polyester resin [A-6] |
| Example 24 | 24 | (1-3) | Behenyl behenate |
| Example 25 | 25 | (1-3) | Distearyl adipic acid |
| Example 26 | 26 | (1-3) | Ethylene glycol distearate |
| Example 27 | 27 | (2-2) | Crystalline polyester resin [A-2] |
| Example 28 | 28 | (2-2) | Crystalline polyester resin [A-5] |
| Example 29 | 29 | (2-2) | Crystalline polyester resin [A-6] |
| Example 30 | 30 | (2-2) | Behenyl behenate |
| Example 31 | 31 | (3-2) | Crystalline polyester resin [A-6] |
| Example 32 | 32 | (3-4) | Crystalline polyester resin [A-6] |
| Comparative example 1 | 33 | — | Crystalline polyester resin [A-1] |
| Comparative example 2 | 34 | (1-3) | — |
| Comparative example 3 | 35 | (2-2) | — |
| Comparative example 4 | 36 | (1-3) | Polyethylene |

[Manufacturing of the Developer]

A ferrite carrier being coated with a silicone resin and having a volume-average particle diameter of 35 μm was mixed with each of the toners [1] to [36] such that the concentration of the toners was 6%, and thus developers [1] to [36] were prepared.

[Evaluation 1: Low-Temperature Fixing Property]

By using a copying machine "bizhub PRO C6550" (manufactured by Konica Minolta Business Technologies, Inc.) which was modified so as to be able to change, from 120 to 200° C., the surface temperature (fixing temperature) of the heating roller of a fixing device, under an environment of constant temperature and constant humidity (temperature 20° C. and humidity 50% RH), a fixing experiment of fixing a solid image on high-quality paper of A4 size having the amount of attachment of toner of 10 mg/$cm^2$ was repeated while the set fixing temperature was changed such that it was increased by 5° C. from 120° C. to 200° C.

Among the fixing experiments in which an image stain caused by low-temperature offset was not visually observed, with assumption that the fixing temperature of the fixing experiment having the lowest fixing temperature was the lowest fixing temperature, an evaluation was performed. The results thereof are shown in Table 6. The result in which the lowest fixing temperature was 140° C. or less was determined to be acceptable.

[Evaluation 2: Fixed Image Strength]

A print item obtained through evaluation 1 was folded with a folding machine such that a load was placed on the solid image, a compressed air of 0.35 Ma was blown to it and the folding line was ranked in five levels indicated in the following evaluation criteria while limit samples was being referenced. With assumption that the fixing temperature of a fixing experiment which was evaluated to be rank 3 for the first time was the fixed image strength, an evaluation was performed. The results thereof are shown in Table 6. The result in which the fixed image strength was 150° C. or less was determined to be acceptable.

—Evaluation Criteria—

Rank 5: No folding line at all

Rank 4: Partial peeling along the folding line

Rank 3: Fine linear peeling along the folding line

Rank 2: Thick linear peeling along the folding line

Rank 1: Significant peeling

[Evaluation 3: Fixing Separation Property]

Through the use of the copying machine "bizhub PRO C6550" (manufactured by Konica Minolta Business Technologies, Inc.), the surface temperature of the heating roller of the fixing device was set to 190° C., and, under an environment of constant temperature and constant humidity (temperature 20° C. and humidity 50% RH), on recording paper "POD gloss coated paper" (manufactured by Oji Paper Co., Ltd.) of A4 size transported vertically, a 10 cm-wide black band shaped solid image extending in the axial direction of the heating roller having the amount of attachment of the toner of 0.5 mg/$cm^2$ was fixed, and the separation property thereof was evaluated in accordance with the following evaluation criteria. The results thereof are shown in Table 6.

"A", "B" and "C" were assumed to be acceptable levels.

—Evaluation Criteria—

A: The recording paper was separated from the heating roller without being curled.

B: Although the recording paper was separated from the heating roller in a separation hook, the mark of the separation hook was almost unnoticeable on the image.

C: The recording paper was separated from the heating roller in the separation hook, and the mark of the separation hook was left on the image.

D: The recording paper was caught in the heating roller, and was not able to be separated from the heating roller.

[Evaluation 4: Long-Term Stability of Charging]

Under an environment of high temperature and high humidity (temperature 30° C., humidity 85% RH), a character image having a print rate of 10% was continuously printed on one hundred thousand sheets, then a test image including a white image and a halftone image was printed, fog on the print was observed and image roughness on the halftone image was observed and an evaluation was performed in accordance with the following evaluation criteria. The results thereof are shown in Table 6.

—Evaluation Criteria—

A: Neither decrease in image density nor fog was observed visually.

B: Although a decrease in image density and/or fog were/was slightly observed with a loupe of 20 times magnification, no problem was found in practical use.

C: Although a decrease in image density and/or fog were/was visually observed, no problem was found in practical use.

D: A decrease in image density and fog were visually observed, and a problem was found in practical use.

[Evaluation 5: Heat-Resistant Storability]

0.5 g of each of the toners [1] to [36] described above was put into a 10 mL glass bottle having an inside diameter of 21 mm, its lid was closed, the glass bottle was shaken 600 times at room temperature with a tap denser "KYT-200" (manufactured by Seishin Enterprise Co., Ltd.) and thereafter the glass bottle was left with the lid being removed in an environment of a temperature of 55° C. and a humidity of 35% RH for 2 hours. Then, the toner was carefully placed on a sieve of 48 meshes (aperture 350 μm) such that a toner aggregate was not shredded, was set in "Powder tester" (manufactured by Hosokawa Micron Corporation) and was fixed with a pressure bar and a knob nut, the Power tester was adjusted to have a vibration strength with a feed width of 1 mm, the amount of toner left on the sieve was measured after application of vibration for 10 seconds, a rate of aggregation of the toner was calculated with the following formula (2) and thus an evaluation was performed. The results thereof are shown in Table 6.

$$\text{Rate of aggregation of toner (\% by mass)} = \{\text{Amount of toner left (g)}/0.5\text{(g)}\} \times 100 \qquad \text{Formula (2)}$$

Meanwhile, a case where the rate of aggregation of the toner was less than 15% by mass was determined to be excellent, a case where it was equal to or more than 15% by mass but equal to or less than 20% by mass was determined to be satisfactory, and a case where it exceeds 20% by mass was determined to be unacceptable because practical use was impossible.

TABLE 6

| | | Evaluation results | | | | |
|---|---|---|---|---|---|---|
| | Toner No. | Low-temperature fixing property | Fixed image strength | Fixing separation property | Long-term stability | Heat-resistant storability |
| Example 1 | 1 | 130° C. | 145° C. | C | C | 17% by mass |
| Example 2 | 2 | 125° C. | 140° C. | B | C | 15% by mass |
| Example 3 | 3 | 120° C. | 130° C. | A | A | 9% by mass |
| Example 4 | 4 | 120° C. | 135° C. | A | A | 7% by mass |
| Example 5 | 5 | 125° C. | 135° C. | A | B | 18% by mass |
| Example 6 | 6 | 120° C. | 135° C. | A | B | 12% by mass |
| Example 7 | 7 | 125° C. | 140° C. | B | B | 14% by mass |
| Example 8 | 8 | 130° C. | 140° C. | B | B | 18% by mass |
| Example 9 | 9 | 120° C. | 130° C. | B | A | 18% by mass |
| Example 10 | 10 | 125° C. | 135° C. | B | A | 15% by mass |
| Example 11 | 11 | 130° C. | 140° C. | C | C | 16% by mass |
| Example 12 | 12 | 130° C. | 140° C. | B | B | 10% by mass |
| Example 13 | 13 | 130° C. | 140° C. | B | C | 15% by mass |
| Example 14 | 14 | 130° C. | 145° C. | C | C | 19% by mass |
| Example 15 | 15 | 120° C. | 130° C. | A | A | 8% by mass |
| Example 16 | 16 | 120° C. | 135° C. | A | A | 9% by mass |
| Example 17 | 17 | 120° C. | 135° C. | A | B | 14% by mass |
| Example 18 | 18 | 120° C. | 130° C. | B | A | 10% by mass |
| Example 19 | 19 | 125° C. | 140° C. | C | B | 19% by mass |
| Example 20 | 20 | 125° C. | 140° C. | B | B | 13% by mass |
| Example 21 | 21 | 125° C. | 135° C. | B | A | 8% by mass |
| Example 22 | 22 | 135° C. | 150° C. | A | A | 6% by mass |
| Example 23 | 23 | 120° C. | 130° C. | B | A | 14% by mass |
| Example 24 | 24 | 135° C. | 145° C. | B | C | 16% by mass |
| Example 25 | 25 | 130° C. | 145° C. | B | B | 16% by mass |
| Example 26 | 26 | 130° C. | 145° C. | B | B | 10% by mass |
| Example 27 | 27 | 125° C. | 135° C. | B | B | 7% by mass |
| Example 28 | 28 | 135° C. | 150° C. | A | B | 10% by mass |
| Example 29 | 29 | 125° C. | 135° C. | B | B | 17% by mass |
| Example 30 | 30 | 140° C. | 150° C. | B | C | 16% by mass |
| Example 31 | 31 | 120° C. | 130° C. | A | B | 17% by mass |
| Example 32 | 32 | 125° C. | 140° C. | B | C | 20% by mass |

TABLE 6-continued

| | Toner No. | Evaluation results | | | | |
|---|---|---|---|---|---|---|
| | | Low-temperature fixing property | Fixed image strength | Fixing separation property | Long-term stability | Heat-resistant storability |
| Comparative Example 1 | 33 | 140° C. | 155° C. | C | D | 29% by mass |
| Comparative Example 2 | 34 | 150° C. | 160° C. | A | A | 8% by mass |
| Comparative Example 3 | 35 | 145° C. | 160° C. | A | B | 15% by mass |
| Comparative Example 4 | 36 | 140° C. | 160° C. | C | D | 31% by mass |

What is claimed is:

1. A toner for electrostatic-image development that is formed with toner particles containing a binder resin and a crystalline ester compound, wherein the binder resin contains a styrene-acrylic resin including a structural unit derived from an acrylic ester monomer represented by any of general formulae (1) to (3) below General formula (1)

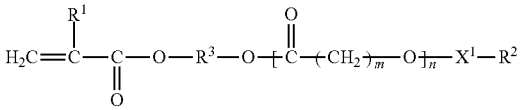

in the general formula (1), $R^1$ represents a hydrogen atom or a methyl group, $X^1$ represents a single bond or —C(=O)—, $R^2$ represents an alkyl group having 1 to 16 carbon atoms or an aryl group having 6 to 15 carbon atoms, $R^3$ represents an alkylene group having 1 to 8 carbon atoms which may contain —O— or —C(=O)—)—, m represents an integer of 2 to 12, and n represents an integer of 2 to 20;

General formula (2)

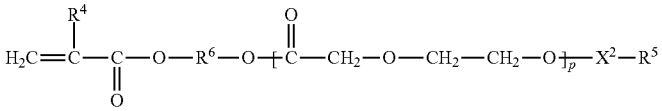

in the general formula (2), $R^4$ represents a hydrogen atom or a methyl group, $X^2$ represents a single bond or —C(=O)—, $R^5$ represents an alkyl group having 1 to 16 carbon atoms or an aryl group having 6 to 15 carbon atoms, $R^6$ represents an alkylene group having 1 to 8 carbon atoms which may contain —O— or —C(=O)—, and p represents an integer of 2 to 20; and General formula (3)

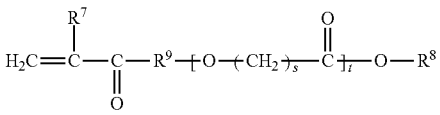

in the general formula (3), $R^7$ represents a hydrogen atom or a methyl group, $R^8$ represents an alkyl group having 1 to 16 carbon atoms or an aryl group having 6 to 15 carbon atoms, $R^9$ represents a single bond or an alkylene group having 1 to 8 carbon atoms which may contain —O— or —C(=O)—, and s represents an integer of 2 to 12 and t represents an integer of 2 to 20.

2. The toner for electrostatic-image development according to claim 1, wherein a ratio of the acrylic ester monomer represented by any of the general formulae (1) to (3) to all monomers used for formation of the styrene-acrylic resin is 2 to 12% by mass.

3. The toner for electrostatic-image development according to claim 1, wherein, in the general formulae (1) to (3), $R^1$, $R^4$ and $R^7$ are each methyl groups.

4. The toner for electrostatic-image development according to claim 1, wherein, in the general formulae (1) and (2), each of $X^1$ and $X^2$ is —C(=O)—.

5. The toner for electrostatic-image development according to claim 1, wherein, in the general formulae (1) to (3), $R^2$, $R^5$ and $R^8$ are each methyl groups.

6. The toner for electrostatic-image development according to claim 1, wherein, in the general formulae (1) and (2), $R^3$ and $R^6$ are each ethylene groups.

7. The toner for electrostatic-image development according to claim 1, wherein, in the general formula (3), $R^9$ is a single bond.

8. The toner for electrostatic-image development according to claim 1, wherein, in the general formulae (1) and (3), m and s are each integers of 4 to 6.

9. The toner for electrostatic-image development according to claim 1, wherein, in the general formulae (1) to (3), n, p and t are each integers of 5 to 10.

10. The toner for electrostatic-image development according to claim 1, wherein, a content of the crystalline ester compound in the toner particles is 1 to 30% by mass.

11. The toner for electrostatic-image development according to claim 1, wherein the crystalline ester compound is a compound having two or more ester bonds.

12. The toner for electrostatic-image development according to claim 11, wherein the crystalline ester compound is a crystalline polyester resin having four or more ester bonds.

13. The toner for electrostatic-image development according to claim 1, wherein, when a solubility parameter value of the crystalline ester compound is SP(E) and a solubility parameter value of the acrylic ester monomer is SP(M), $SP(E) \leq SP(M)$ is satisfied.

14. The toner for electrostatic-image development according to claim 1, wherein the toner particles contain a wax having a composition different from a composition of the crystalline ester compound.

15. The toner for electrostatic-image development according to claim 14, wherein, when a solubility parameter value of the crystalline ester compound is SP(E) and a solubility parameter value of the wax is SP(W), then $SP(W) < SP(E)$ is satisfied.

* * * * *